US008783013B2

(12) United States Patent
Gates et al.

(10) Patent No.: US 8,783,013 B2
(45) Date of Patent: Jul. 22, 2014

(54) FEEDFORWARD SELECTIVE CATALYTIC REDUCTION SYSTEM FOR TURBINE ENGINES

(75) Inventors: Christopher A. Gates, Orlando, FL (US); Uygar O. Selman, Oviedo, FL (US); Teri J. Robertson, Satellite Beach, FL (US); Christopher L. Moering, Oviedo, FL (US); David D. Elwood, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 793 days.

(21) Appl. No.: 12/908,965

(22) Filed: Oct. 21, 2010

(65) Prior Publication Data

US 2012/0096835 A1 Apr. 26, 2012

(51) Int. Cl.

| | |
|---|---|
| ***F01N 3/00*** | (2006.01) |
| ***F01N 3/02*** | (2006.01) |
| ***F01N 3/20*** | (2006.01) |

(52) U.S. Cl.

USPC ..... 60/277; 60/274; 60/286; 60/295; 60/301

(58) Field of Classification Search

USPC ..... 60/274, 286, 295, 301

See application file for complete search history.

(56) References Cited

U.S. PATENT DOCUMENTS

| | | | | |
|---|---|---|---|---|
| 4,353,206 | A | 10/1982 | Lee | |
| 4,353,207 | A | 10/1982 | Lee | |
| 4,473,536 | A | 9/1984 | Carberg et al. | |
| 4,473,537 | A | 9/1984 | Ford, Jr. et al. | |
| 5,021,227 | A | 6/1991 | Kobayashi et al. | |
| 5,165,903 | A | 11/1992 | Hunt et al. | |
| 5,601,792 | A | 2/1997 | Hug et al. | |
| 5,813,212 | A | 9/1998 | Oguchi et al. | |
| 5,988,115 | A | 11/1999 | Anderson et al. | |
| 6,258,336 | B1 | 7/2001 | Breen et al. | |
| 6,432,373 | B1 | 8/2002 | Tanazawa et al. | |
| 6,868,294 | B2 | 3/2005 | Kouno et al. | |
| 7,063,642 | B1 | 6/2006 | Hu et al. | |
| 7,150,145 | B2 | 12/2006 | Patchett et al. | |
| 7,166,262 | B2 | 1/2007 | Buzanowski | |
| 7,390,471 | B2 | 6/2008 | Sobolevskiy et al. | |
| 7,500,437 | B2 | 3/2009 | Lefebvre et al. | |
| 2007/0110643 | A1 | 5/2007 | Sobolevskiy et al. | |
| 2007/0245714 | A1 | 10/2007 | Frazier et al. | |
| 2008/0116054 | A1 | 5/2008 | Leach et al. | |
| 2008/0299016 | A1 | 12/2008 | Sobolevskiy et al. | |
| 2009/0142243 | A1 | 6/2009 | Eiteneer et al. | |
| 2009/0185954 | A1 | 7/2009 | Qi et al. | |
| 2009/0259386 | A1* | 10/2009 | Eiraku et al. | 701/103 |
| 2010/0024397 | A1* | 2/2010 | Chi et al. | 60/285 |
| 2010/0058740 | A1* | 3/2010 | Kurtz | 60/286 |

* cited by examiner

*Primary Examiner* — Kenneth Bomberg
*Assistant Examiner* — Dapinder Singh

(57) ABSTRACT

A system and method of treating an exhaust flow including nitrogen oxides (NOx) in a turbine engine power generation plant is provided. The turbine engine has a selective catalytic reduction system having a catalyst. During steady state operation of the engine, a reducing agent, such as ammonia, is supplied to an injector in an amount based on a measured molar flow of NOx in the exhaust flow. During a disturbance in the operation of the turbine engine, a reducing agent is supplied to the injector in an amount based on a predicted molar flow of NOx in the exhaust flow. In addition, the system can include a biasing feature in which additional reducing agent is supplied to the exhaust flow beyond the predicted molar flow of NOx. The system and method can mitigate NOx during transient engine operation, an operational mode in which emissions are difficult to predict and control.

18 Claims, 4 Drawing Sheets

FEEDFORWARD SELECTIVE CATALYTIC REDUCTION SYSTEM FOR TURBINE ENGINES

FIELD OF THE INVENTION

The invention relates in general to turbine engines and, more particularly, to the treatment of pollutants in the exhaust of turbine engines.

BACKGROUND OF THE INVENTION

In order to reduce emissions of air pollutants, especially nitrogen oxides (NOx), from gas turbine power generation plants, emissions regulations and air permitting standards are becoming increasingly stringent, particularly in active market areas (e.g. California). Selective catalytic reduction (SCR) is one technology that is currently being used to reduce emissions of NOx to acceptable permit levels. One reducing agent that is commonly used in SCR systems is ammonia ($NH_3$).

Ammonia, typically in gaseous form, is injected into the exhaust flow path by an injection grid where it reacts with the NOx, facilitated by a catalyst, to convert the NOx into non-harmful substances, namely, nitrogen and water. Common reactions include:

$$4NO+4NH_3+O_2 \rightarrow N_2+6H_2O$$

$$2NO_2+4NH_3+O_2 \rightarrow 3N_2 6H_2O$$

$$NO+NO_2+2NH_3 \rightarrow 2N_2+3H_2O$$

Ammonia reacts with NOx in a substantially equimolar manner. It is important to supply an appropriate amount of ammonia to the exhaust flow. On one hand, too little ammonia leads to unacceptably high NOx levels exhausted to the atmosphere. On the other hand, too much ammonia increases the likelihood that ammonia may pass through an SCR unit without reacting (known as ammonia slip), potentially reaching environmentally harmful levels in the final exhaust. In either case, violations of regulatory requirements may occur, resulting in penalties.

NOx emissions levels are measured and recorded by a Continuous Emissions Monitoring System (CEMS) disposed in the exhaust stack downstream of the SCR unit to evaluate air permit compliance. However, there is a large inherent time lag for most CEMS to provide feedback to the system controller, and it is difficult to accurately predict the appropriate flow to the SCR during gas turbine ramps (i.e., changes in load), leading to a mismatch between the amount of ammonia supplied relative to the amount of NOx in the exhaust flow. However, by the time the mismatch is detected by the CEMS, unacceptable amounts of harmful pollutants may have already been released to the atmosphere.

Thus, there is a need for a system and method that can minimize such concerns.

SUMMARY OF THE INVENTION

In one respect, embodiments of the invention are directed to a method of treating an exhaust flow in a turbine engine. The exhaust flow includes nitrogen oxides. The turbine engine has a selective catalytic reduction system that includes a catalyst. The turbine engine can operate under steady state conditions.

According to the method, the molar flow of nitrogen oxides in the exhaust flow is predicted. During steady state operation of the turbine, any of a number of disturbances can occur. For example, the disturbance can be a load ramp. The disturbance can be a change in the pilot fuel flow rate, the duct burner fuel flow rate and/or the premix fuel flow rate. Disturbances in the steady state operation of the turbine engine can be detected.

Responsive to detecting a disturbance, a reducing agent is supplied to the exhaust flow upstream of the catalyst relative to the direction of exhaust flow. The amount of reducing agent supplied is based on the predicted molar flow of nitrogen oxides in the exhaust flow. In one embodiment, the reducing agent can be ammonia.

The method can further include the step of selectively biasing the amount of reducing agent supplied to the exhaust flow upstream of the catalyst. Such selective biasing can be discontinued so that the supply of reducing agent to the exhaust flow upstream of the selective catalytic reduction system is based solely on the predicted molar flow of nitrogen oxides in the exhaust flow of the turbine.

In one embodiment, the step of supplying a reducing agent based on the predicted molar flow of nitrogen oxides in the exhaust flow of the turbine can be discontinued. Such discontinuance can occur at any suitable time, such as either after a predetermined amount of time has elapsed or after the end of the disturbance. The molar flow of nitrogen oxides in the exhaust flow upstream of the selective catalytic reduction system can be measured. Thus, when the reducing agent is no longer supplied based on a predicted molar flow of nitrogen oxides, the reducing agent can be supplied to the exhaust flow upstream of the catalyst relative to the direction of exhaust flow based on the measured molar flow of nitrogen oxides in the exhaust flow.

The prediction of the molar flow of nitrogen oxides in the exhaust flow can be performed in any suitable manner. In one embodiment, an exhaust molar flow rate can be determined by adding a determined compressor molar flow rate and a determined fuel molar flow rate.

The compressor molar flow rate can be determined in any suitable manner. For example, the compressor molar flow rate can be determined by determining a reference compressor mass flow rate, a weight of dry air inducted in engine and one or more correction factors. The determined reference compressor mass flow rate can be adjusted by the determined weight of dry air inducted in engine and the one or more determined correction factors. The adjusted reference compressor mass flow rate can be divided by the molecular weight of air. Any suitable correction factor can be used. For instance, the correction factor can be a pressure correction factor and/or a gas turbine degradation factor.

The fuel molar flow rate can be determined in any suitable manner. For instance, such determination can be made by measuring fuel flow in the turbine engine including pilot fuel flow and/or premix fuel flow. In some instances, the fuel flow of a duct burner can also be measured. The measured fuel flow can be divided by the molecular weight of the fuel.

The turbine engine can include a compressor section with an evaporative cooler. The evaporative cooler can have an operational status of being either on or off. The method can include the step of determining the operational status of the evaporative cooler. Based on the determined operational status of the evaporative cooler, the steps of determining the reference compressor mass flow rate and the weight of dry air inducted in engine can be adjusted.

The method can also include the step of measuring the molar flow of nitrogen oxides in the exhaust flow. The difference between the measured molar flow of nitrogen oxides in the exhaust flow and the predicted molar flow of nitrogen oxides in the exhaust flow can be determined to yield an error factor. The error factor can be applied to the predicted molar flow of nitrogen oxides in the exhaust flow. In this way, the predicted molar flow can be made to equal the measured molar flow. When a disturbance in the steady state operation of the turbine engine is detected, the error factor can be held constant at the error factor that is currently being applied at that time.

In another respect, aspects of the invention are directed to a selective catalytic reduction system for treating an exhaust flow including nitrogen oxides in a turbine engine. The system includes a turbine engine having an exhaust section fluidly connected to receive an exhaust flow from a turbine section of the engine. The system also includes a selective catalytic reduction system having an injector and a catalyst. The catalyst is disposed in the exhaust flow and downstream of the injector relative to the direction of exhaust flow.

A reducing agent supply source is in fluid communication with the injector by a fluid conduit. A flow control valve is disposed along the fluid conduit. A system controller is operatively connected to flow control valve. The system controller is configured to selectively open and close the flow control valve.

During steady state operation of the turbine engine, the system controller operates the flow control valve to supply a reducing agent to the injector in an amount based on a measured molar flow of nitrogen oxides in the exhaust flow. During a disturbance in the operation of the turbine engine, the system controller operates the flow control valve to supply a reducing agent to the injector in an amount based on a predicted molar flow of nitrogen oxides in the exhaust flow.

The predicted molar flow of nitrogen oxides can be determined by the summation of a compressor molar flow rate and a fuel molar flow rate. The predicted molar flow of nitrogen oxides can be adjusted by an error factor. The error factor can be the difference between the predicted molar flow of nitrogen oxides and the measured molar flow of nitrogen oxides upstream of the selective catalytic reduction system relative to the direction of the exhaust flow.

During a disturbance in the operation of the turbine engine, the system controller may further operate the flow control valve further based on a bias. In such instances, the flow control valve can be controlled to supply a reducing agent to the injector in addition to the amount based on a predicted molar flow of nitrogen oxides in the exhaust flow.

DETAILED DESCRIPTION OF EMBODIMENTS OF THE INVENTION

Embodiments of the invention are directed to a selective catalytic reduction system to minimize NOx emissions. Aspects of the invention will be explained in connection with the treatment of exhaust emissions in a gas turbine power plant, but the detailed description is intended only as exemplary. Embodiments of the invention are shown in FIGS. 1-4, but the present invention is not limited to the illustrated structure or application.

A system according to aspects of the invention can minimize the feedback lag time and consequent ammonia-NOx mismatch experienced by current SCR systems, particularly when there are disturbances in the operation of the gas turbine engine. A disturbance means any conditions that can result in a change (increase or decrease) in the molar amount of NOx in the engine exhaust. Such disturbances can include transient engine operation, that is, any increase or decrease in engine load. Further, to maintain engine flame stability during load changes, fuel injection can be adjusted to increase the diffusion flame via the pilot nozzle and to reduce the dispersion flame. While the flame is made more stable, NOx emissions are concurrently increased. In some instances, the system can be particularly beneficial during load ramps of at least about 4 megawatts per minute where pilot fuel flow is temporarily increased by about 1 percent of the total fuel flow. These disturbances can also include changes (increases or decreases) in the amount of pilot fuel flow, thus making them predictable.

Figure 1:
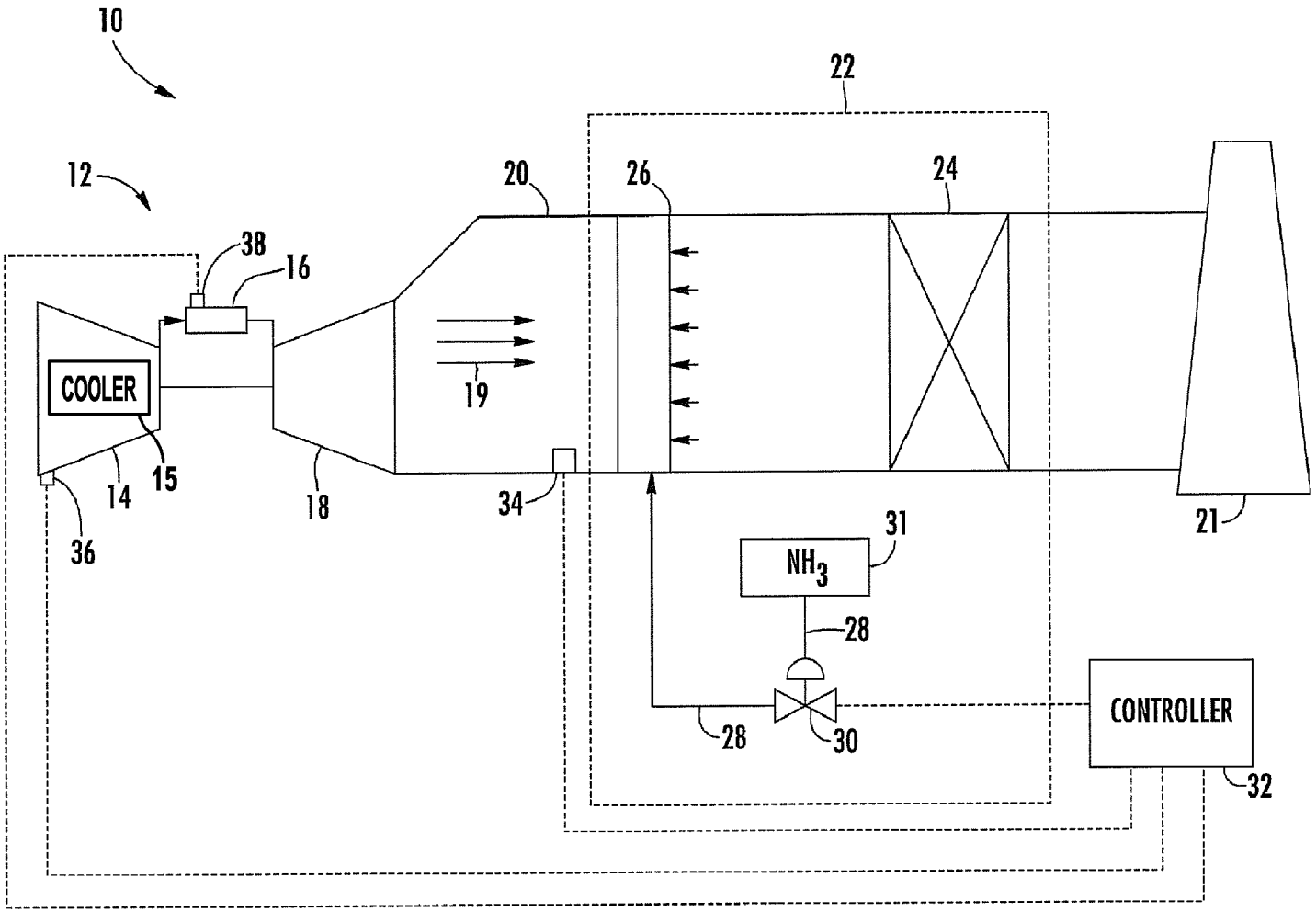
FIG. 1 is a schematic view of a gas turbine power generation plant with a selective catalytic reduction system according to aspects of the invention.

Referring to FIG. 1, a power generation plant 10 can include a gas turbine engine 12. The turbine engine 12 generally includes a compressor section 14, a combustor section 16, a turbine section 18 and an exhaust section 20. In operation, the compressor section 14 can induct ambient air and can compress it. The compressed air from the compressor section 14 can enter one or more combustors in the combustor section 16. The compressed air can be mixed with fuel, and the air-fuel mixture can be burned in the combustors to form a hot working gas. Fuel can be added to the compressed air at various points in the combustor section 16. For example, fuel can be added upstream of the combustion zone by one or more premix fuel nozzles. Alternatively or in addition, fuel can be added in the combustion zone by one or more pilot nozzles and/or one or more main nozzles. The fuel may be any suitable type of fuel and can be supplied in any suitable form.

The hot gas can be routed to the turbine section 18 where it is expanded through alternating rows of stationary airfoils and rotating airfoils and used to generate power that can drive a rotor. The expanded gas exiting the turbine section 18 can be exhausted from the engine via the exhaust section 20. Exhaust gases from the turbine can pass through a heat recovery steam generator (not shown), after which the exhaust gases exit an exhaust stack 21 to the atmosphere. A duct burner (not shown) can be located within the heat recovery steam generator. Fuel can be supplied to the duct burner.

An SCR unit 22 can be disposed in the exhaust flow path 19. The SCR unit 22 can include a catalyst 24 disposed in the exhaust flow path and a reducing agent injector, such as an injection grid 26, disposed upstream of the catalyst 24 relative to the direction of exhaust gas flow path 19. A reducing agent source 31 can be in fluid communication to supply a reducing agent to the injection grid 26, such as by a fluid supply conduit 28. The reducing agent can be ammonia ($NH_3$). A flow control valve 30 can be disposed along the supply conduit 28 to selectively control the flow of reducing agent along the supply conduit 28. A system controller 32 can be operatively connected to the ammonia flow control valve 30 to selectively regulate the flow of reducing agent to the injection grid 26. The controller 32 can selectively increase and/or decrease the flow of the reducing agent to the injection grid 26.

The system controller 32 can be an electronic control circuit and can be comprised of hardware, software or any combination thereof. In addition to controlling components within the power generation plant 10, the system controller 32 can include data collection and analysis capabilities. For instance, the system controller 32 can be operatively connected to one or more sensors within the power generation plant 10 to provide desired data. The term "operatively connected," as used herein, can include direct or indirect connections, including connections without direct physical contact. The system controller 32 can be operatively connected to one or more sensors 36 operatively positioned with respect to the compressor section 14 to provide data on, for example, the angle of the inlet guide vanes, gas turbine inlet temperature, gas turbine inlet pressure and evaporative cooler status. Further, the system controller 32 can be operatively connected to one or more sensors 38 operatively positioned with respect to the combustor section 16 to provide data on, among other things, mass flow rate of pilot fuel flow, premix fuel flow, and/or main nozzle fuel flow. Still further, the system controller 32 can be operatively connected to one or more sensors 34 operatively positioned with respect to the exhaust section 20 to provide data on the amount of NOx at the inlet of the SCR unit 22. The system controller 32 can be operatively positioned in any suitable location within the power generation plant 10 to provide the desired data, such as the number of operating hours of the engine.

The system controller 32 can utilize a prediction algorithm, and data collection can be performed on a data acquisition system. In one respect, aspects of the invention are directed to a feedforward system that can predict or estimate the molar flow rate of the gas turbine exhaust with a greater degree of accuracy. In another respect, aspects of the invention are directed to the use of biases in determining an appropriate amount of reducing agent to supply to the injection grid. These aspects can cooperate to predict the amount of NOx in the exhaust flow to minimize lag during disturbances in engine operation so that an appropriate amount of ammonia is supplied to the exhaust. Each of these aspects will be examined in turn below.

A feedforward system according to aspects of the invention can predict the exhaust molar flow rate (Ndry exhaust). The exhaust molar flow rate (Ndry exhaust) can be predicted by the summation of the compressor molar flow rate (Ncomp) and the fuel molar flow rate (Nfuel). The determination of each of these flow rates will be described in turn below.

Figure 2:
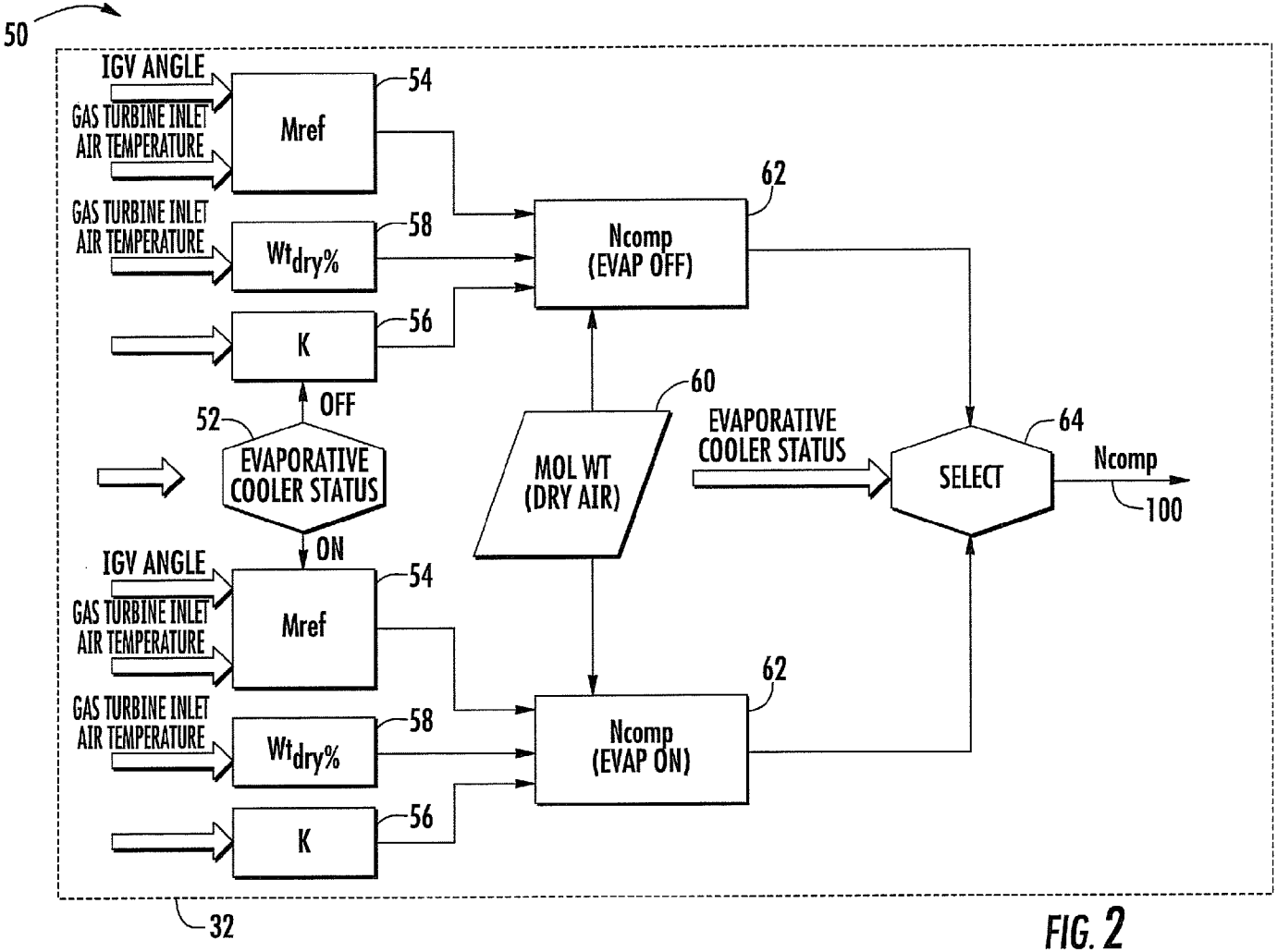
FIG. 2 is a diagrammatic view of a system for determining a compressor molar flow according to aspects of the invention.

The compressor molar flow rate (Ncomp) can be determined in any suitable manner. One example of a system 50 for determining the compressor molar flow rate (Ncomp) is shown in FIG. 2. The compressor molar flow rate (Ncomp) can be determined according to the following formula:

$$Ncomp = \frac{Mref * Wtdry\ \% * K}{\text{Mol Wt (dry air)}}$$

K generally represents one or more correction factors.

A number of factors can be considered to determine the compressor molar flow rate: gas turbine inlet temperature, pressure at the gas turbine inlet, angle of the inlet guide vanes, engine operating hours and evaporative cooler status. These factors can be measured using new or existing measurement devices, which can be, for example, sensors or any other suitable device operatively positioned within the power generation plant 10. These factors can be measured at any suitable interval. These factors can be measured at the substantially same time or at different times. These factors can be measured in any suitable units of measurement.

The compressor section 14 can have an evaporative cooler 15, which can increase the mass flow of the air inducted at the inlet of the turbine engine 12. As shown at step 52 in FIG. 2, the operational status of the evaporative cooler 15 can be determined as being on or off. Based on this status, the measured gas turbine inlet air temperature and the angle of the inlet guide vanes, a compressor reference mass flow rate (Mref) can be determined, as is shown at step 54 in FIG. 2.

The compressor reference mass flow rate (Mref) can be a function of inlet guide vane angle and ambient temperature, which can be measured at the inlet of the gas turbine engine. In one engine installation, the compressor reference mass flow rate (Mref) can be determined as:

If the evaporative cooler is on:

$$Mref=-29938.2(x)-5799(y)+82.33859(x*y)-369.448(x^2)-30.0209(y^2)+0.636655(x*y^2)+4231285$$

If the evaporative cooler if off:

$$Mref=-23920.6(x)-5835.92(y)-49.4738(x*y)-538.853(x^2)-20.5669(y^2)+4.133428(x^2*y)+1.209367(x*y^2)-0.02366(x^2*y^2)+4203904$$

In either case, x=IGV Angle (degrees); y=temperature (degrees Fahrenheit). These equations are engine specific and site specific. Thus, they may vary from site to site and/or engine to engine.

The reference mass flow can be adjusted based on one or more correction factors (K), as shown at 56 in FIG. 2, in determining the compressor molar flow rate (Ncomp). Any number of correction factors (K) can be used. The greater the number of factors, the more accurate the determined compressor molar flow rate (Ncomp) will be. The correction factors (K) can be determined based on any suitable data. The correction factors (K) can be provided as a multiplier to be applied to the compressor mass flow rate (Mref).

One correction factor can be a pressure correction factor (Kp). The pressure correction factor (Kp) can be a function of ambient pressure, which can be measured at the inlet of the gas turbine engine. The pressure correction factor can be calculated using the air pressure measured at the inlet of the gas turbine engine 12. Any suitable unit of measurement can be used for the air pressure, such as in psia. The pressure correction factor (Kp) can be computed at any suitable interval, such as about every 5 minutes. If more than one pressure sensor is used, an average of the measurements can be used. In one engine installation, the pressure correction factor (Kp) can be determined as:

If the evaporative cooler is on: $Kp=(6.909*10^{-2})*x-1.358*10^{-2}$

If the evaporative cooler if off: $Kp=(6.896*10^{-2})*x-1.171*10^{-2}$

In either case, x=pressure (psia). These equations are engine specific and site specific. Thus, they may vary from site to site and/or from engine to engine.

Another correction factor (Kdeg) can account for the degradation of the gas turbine engine 12 over time. As the gas turbine engine 12 ages, the amount of NOx that is produced by the engine 12 can be affected. Generally, the older the engine, the greater the amount of NOx that it produces. The degradation corrector factor (Kdeg) can be a function of the engine operating hours. Thus, based on the number of engine operating hours, the degradation corrector factor (Kdeg) can be calculated. This correction factor can be computed at any suitable interval, such as daily. One example of a manner of calculating the degradation corrector factor (Kdeg) is presented below, regardless of the operational status of the evaporative cooler:

$$Kdeg=(-1.135*10^{-15})*x^3+(5.716*10^{-11})*x^2-(1.082*10^{-6})*x+9.988*10^{-1}$$

x=the number of engine operating hours (hours).

It will be understood that the above noted correction factors (K) are provided as examples and are not intended to be an exhaustive listing of all possible correction factors. Additional factors can be considered, including, for example, changes in the ratio of carbon monoxide (CO) to carbon dioxide (CO2) with changes in ambient temperature or otherwise. The inclusion of additional factors can increase the degree of accuracy of the ultimate calculation of compressor molar flow (Ncomp).

The compressor mass flow rate (Mref) can be adjusted by the desired corrections factors. For instance, the reference mass flow can be multiplied by the degradation correction factor (Kdeg) and/or the pressure correction factor (Kp). The product can be multiplied by the weight of the air (Wt dry %). The weight of the air (Wt dry %) can be a function of ambient temperature, which can be measured at the inlet of the gas turbine engine. In one embodiment, as shown at 58 in FIG. 2, the weight of the air (Wt dry %) can be determined as follows:

$$\text{If the evaporative cooler is on: Wt dry \%}=(-5.25*10^{-6})*x^2+(2.71*10^{-4})*x+9.92*10^{-1}$$

$$\text{If the evaporative cooler if off: Wt dry \%}=(-8.33*10^{-7})*x^2-(7.34*10^{-5})*x+1.00$$

In either case, x=temperature (degrees Fahrenheit). These equations are engine specific and site specific. Thus, they may from site to site.

Referring to step 62 in FIG. 2, the product of Mref 54, K 56 and Wt dry % 58 can then be divided by the anticipated molecular weight (Mol Wt) of dry air 60, which can be 28.96 lbm/lbmol, for the given prevailing temperature to provide the compressor molar flow rate (Ncomp). Based on the operational status of the evaporative cooler, the system controller 32 can, at step 64, select between the Ncomp (evaporator off) or Ncomp (evaporator on) to be used as Ncomp 100.

Figure 3:
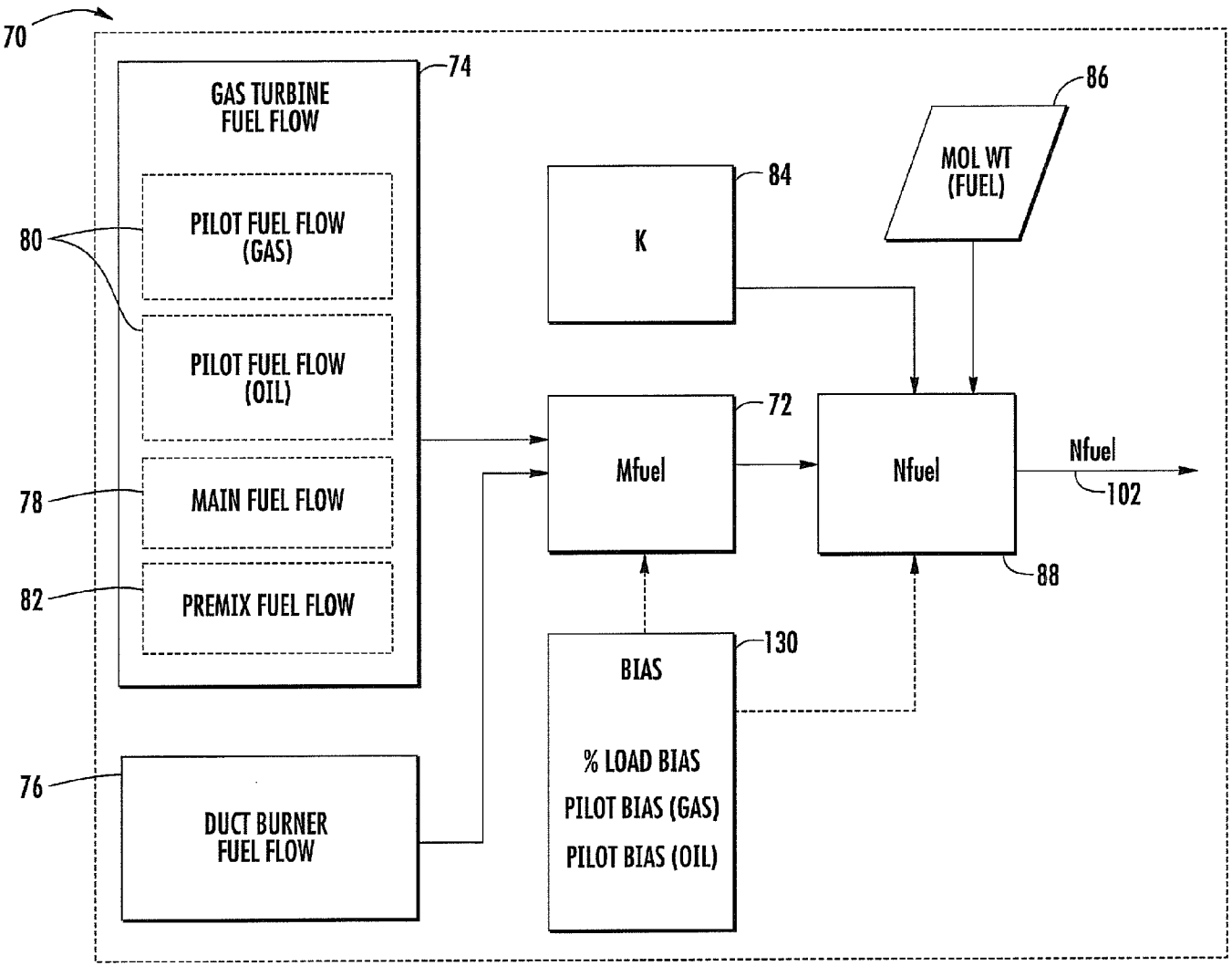
FIG. 3 is a diagrammatic view of a system for determining a fuel molar flow according to aspects of the invention.

The compressor molar flow (Ncomp) accounts for the gases ingested at the inlet of the gas turbine engine 12, but there are additional flows in the engine 12 that can affect the composition of the turbine exhaust flow 19. In particular, fuel is added at various points in the turbine engine system, such as in the combustor section 12 or in the duct burner (not shown) in the exhaust 20. A fuel molar flow rate (Nfuel) can be determined in any suitable manner. One example of a system 70 for determining the fuel molar flow rate (Nfuel) is shown in FIG. 3. The fuel molar flow rate (Nfuel) can be determined according to the following formula:

$$Nfuel = \frac{Mfuel * K}{\text{Mol Wt (fuel)}}$$

K generally represents one or more correction factors, as explained below.

The mass flow of fuel (Mfuel) 72 can be determined by the summation of the mass flow of the gas turbine fuel flow 74 and the duct burner fuel flow 76. Contributors to the mass flow of the gas turbine fuel flow 74 can include fuel added by main fuel nozzles 78, pilot fuel nozzles 80 and any fuel nozzles located upstream of the combustion zone to promote premixing of the air and fuel 82 (sometimes referred to as stage 3 or C-stage). Each of these fuel flows 74, 76, 78, 80, 82 can affect the amount of NOx generated in the final exhaust and the rate at which NOx is generated. For example, the pilot nozzle fuel flow 80 can be a significant contributor to NOx during a disturbance in engine operation. The mass flow of fuel (Mfuel) 72 can be measured using new or existing sensors and can be measured in any suitable measurement unit, such as in lbmol/hour. The system controller 32 can monitor and measure various fuel flows within the engine 12 or power generation system 10. These measurements should be taken as often as possible.

The fuel mass flow (Mfuel) 72 can be adjusted based on one or more correction factors (K). Any number of correction factors (K) can be used. The greater the number of correction factors (K), the more accurate the determined fuel molar flow rate (Nfuel) will be. The correction factors (K) can be provided as a multiplier to be applied to the fuel mass flow (Mfuel) 72.

One correction factor can be a fuel correction factor (Kfuel). This correction factor can take into account the relative quantities and compositions of fuel being supplied in the engine. This correction factor may also take into account the stoichiometry of reactions. It can also take into account the current operational load of the engine. In one engine, fuel correction factor (Kfuel) can be −0.96088 when the fuel is gas. The fuel correction factor (Kfuel) can be −0.03374 when the fuel is oil.

Another possible correction factor is the combustion reaction correction factor (Kreact). This factor can take into account the change in molar count due to the combustion process. Thus, stoichiometrics can be used to calculate an appropriate combustion reaction correction factor (Kreact). The combustion reaction correction factor (Kreact) can be a constant value.

The fuel mass flow (Mfuel) 72 can be adjusted by the desired correction factors (K) 84. For instance, the fuel mass flow (Mfuel) 72 can be multiplied by the fuel correction factor (Kfuel) and/or the combustion reaction correction factor (Kreact). At step 86, this product can then be divided by the molecular weight (Mol Wt) of fuel (16.75 lbm/lbmol for natural gas) to yield the fuel molar flow rate (Nfuel) at 88, which can be in any suitable units such as lbmol/hour. This calculation can be expressed mathematically as:

$$Nfuel = \frac{Mfuel * K}{\text{Mol Wt (fuel)}}$$

K generally represents one or more correction factors.

Figure 4:
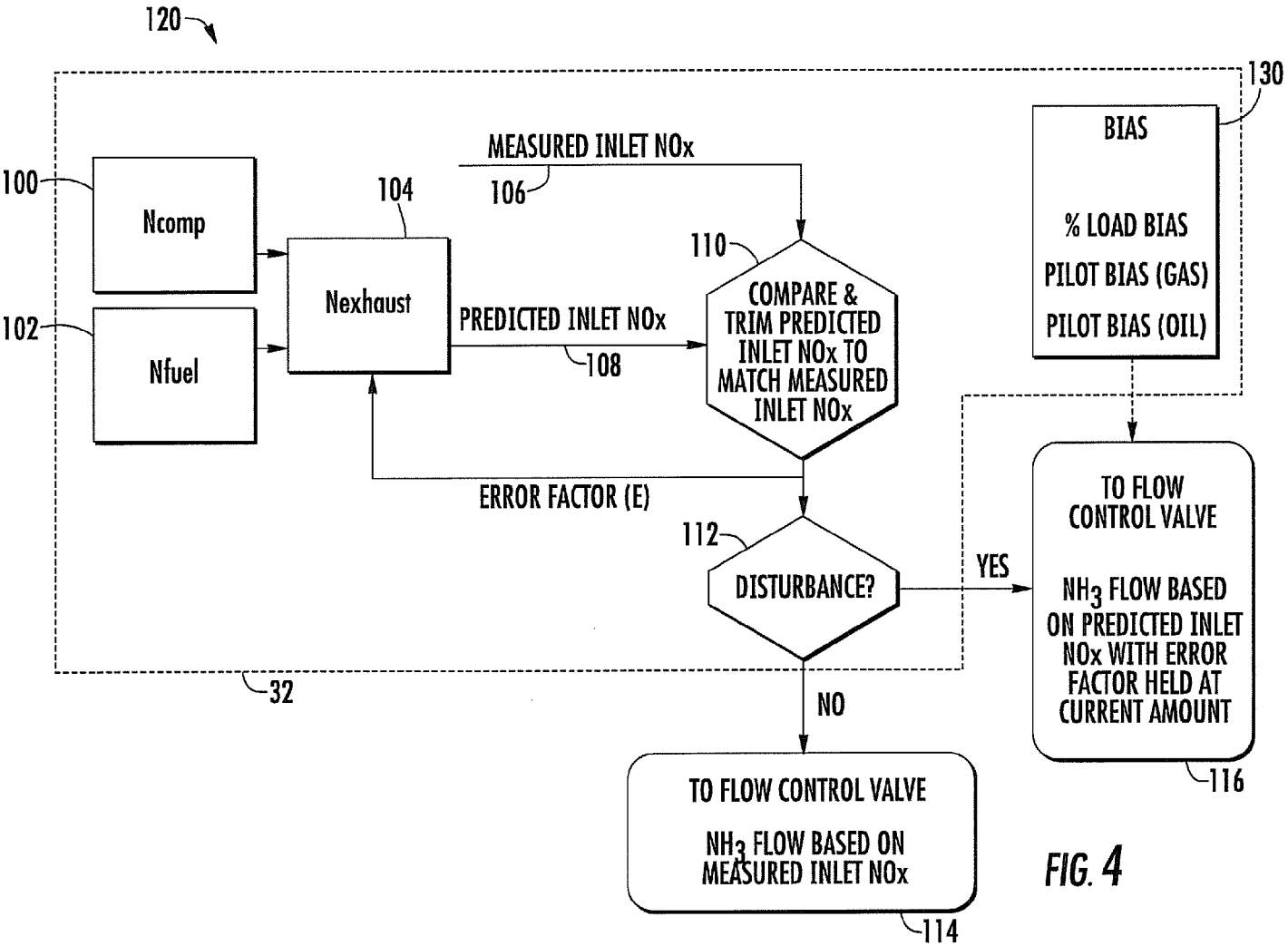
FIG. 4 is a diagrammatic view of a system for controlling the flow of a reducing agent to the exhaust of a gas turbine power generation plant according to aspects of the invention.

Referring to FIG. 4, a system 120 for controlling the flow of a reducing agent to the exhaust flow 19 of the gas turbine power generation plant 10 is shown. Once the compressor molar flow (Ncomp) 100 and the fuel molar flow (Nfuel) 102 are determined, the exhaust molar flow (Ndry exhaust) 104 can be determined according to the following formula:

$$N\text{dry exhaust}=N\text{comp}+N\text{fuel}$$

From the determined exhaust molar flow (Ndry exhaust) 104, the predicted amount of NOx 108 at the inlet of the SCR unit 22 can be determined.

The above calculations and measurements can be performed on the system controller 32 at the gas turbine power generation plant 10 (FIG. 1). The system controller 32 can selectively operate the flow control valve 30 to allow the appropriate amount of reducing agent to be supplied from the source 31 to the SCR injection grid 26. To that end, the amount of NOx at the inlet of the selective catalytic reduction (SCR) system 22 can be measured. The measured NOx 106 (FIG. 4) can be measured by a sensor 34 or other suitable device located in or near the exhaust flow 19 at or before the inlet of the SCR system 22. The measured NOx 106 can be stored on the system controller 32. The measured amount of NOx 106 at the inlet of the SCR unit 22 can be measured in ppmvd. If so, it can be converted into a NOx molar flow rate in lbmol/hour, which is also encompassed in the term "measured NOx," "measured inlet NOx" and variations thereof.

During steady state operating conditions, that is, when the engine load is substantially constant or there are no appreciable disturbances in the operation of the engine 12, the system controller 32 can compare the measured inlet NOx 106 and the predicted inlet NOx 108 at step 110, as is shown in FIG. 4. The difference between the measured inlet NOx 106 and the predicted inlet NOx 108 can yield an error factor (E), which can be a positive or a negative value. The error factor (E) can be applied to the predicted inlet NOx 108 so that the predicted NOx 108 is trimmed or made to equal to the measured inlet NOx 106. The error factor (E) can be continually applied to the predicted NOx 108 until there is another difference between the predicted inlet NOx 108 and the measured inlet NOx 106, at which point a new correction factor (E) can be determined and applied to the predicted inlet NOx 108.

During steady state operation of the engine 12, the controller 32 can selectively operate the flow control valve 30 to allow an appropriate amount of ammonia to be supplied to the injection grid 26 based on the measured amount of NOx 106 at the inlet of the SCR system 22, as is shown at step 114. The appropriate amount of ammonia can be based on the principle that ammonia reacts with NOx in a substantially equimolar manner.

However, if there is a disturbance 112 in the steady state operation of the engine 12, the amount of NOx in the exhaust flow 19 can change so rapidly that the NOx emissions levels measured at the inlet of the SCR unit 22 may no longer be reliable for determining the appropriate amount of ammonia to supply to the injection grid 26. The change may not be seen for a period of time, potentially on the order of about one minute or more, during which excess NOx or excess ammonia may be released into the atmosphere, potentially violating permitting requirements.

In such case, the controller 32 can operate the flow control valve 30 to supply ammonia to the SCR injection grid 26 according to the predicted NOx 108 rather than waiting for the measured NOx 106, as is shown at step 116. The current error factor (E) can continue to be applied, but it can be maintained at the value currently being applied at the time the disruption is detected and any subsequent changes in the error factor (E) can be ignored. Thus, instead of supplying ammonia based on measured NOx 106 at the inlet of the SCR unit 22, the predicted amount of NOx 108 based on the above scheme can be relied on to determine the appropriate amount of ammonia to supply to the exhaust flow 19. Once an amount of time has elapsed, such as the expected lag time or until steady state engine operation has resumed, the controller 32 can switch to supplying ammonia based on the measured NOx 106 at the SCR inlet, as described above.

Alternatively or in addition to the above control components, a system according to aspects of the invention can use one or more artificial biases 130 to compensate, at least initially, for changes in NOx generation during a disturbance in the operation of the engine 12. For instance, these biases 130 can be applied during engine ramps to compensate for NOx level changes caused by the resultant changes in pilot fuel flow and changing premix fuel flow. Such biases 130 can also be applied for any appreciable change in pilot flow and/or change in duct burner flow. These biases 130 can be applied for a duration equivalent to the expected time lag for the stack exhaust NOx measurement, that is, the time it takes for the predicted NOx amount to reach the exhaust. These biases 130 can help to offset the increased NOx levels typical to the increased pilot flow and premix fuel flow for increasing ramp rates. These biases 130 can also help to offset the decreased NOx levels typical to the decreased pilot flow and premix fuel flow for decreasing ramp rates.

The biases 130 can be added to or subtracted from the fuel mass flow (Mfuel) and/or the fuel molar flow (Nfuel) determination, as is shown at steps 72 and 88, respectively, in FIG. 2. The biases 130 can be predetermined amounts. In such case, when a disturbance is detected, a predetermined bias can be added to the fuel mass flow (Mfuel) and/or the fuel molar flow (Nfuel) determination. In some instances, the biases 130 can be proportional to the percent increase or decrease in the condition giving rise to the disturbance. Alternatively, the biases 130 can be applied separately from the exhaust molar flow rate calculation. For instance, when a disturbance is detected, the system controller 34 can send a signal to selectively increase or decrease the flow ammonia automatically without waiting for the measured NOx 106 or without waiting to determine the predicted NOx 108. For example, when pilot flow is detected as increasing, the system controller 32 can open the flow control valve 30 to allow additional ammonia to flow to the injection grid 26, in addition to the predicted amount of ammonia that should be supplied at 116 (see FIG. 4). The increase in pilot flow may be offset by any change in premix fuel flow, as an increase in such flow does not result in NOx formation.

The biasing 130 can be applied upon the detection of a disturbance, as experience has shown that the predicted inlet NOx 108 may not initially be sufficient. Thus, the biasing 130 can allow for more or less ammonia to be supplied to the injection grid 26, depending on the circumstances. The magnitude of the biasing 130 may be directly proportional to the magnitude of the disturbance. The biasing 130 can be applied at a constant level or in a gradually reducing manner. The biasing 130 can continue to be applied for any suitable duration. In one embodiment, the biasing 130 can be discontinued once the predicted NOx 108 based on the determined exhaust molar flow rate (Ndry exhaust) 104 is sufficient or until steady state operating conditions are achieved.

It will be appreciated that systems and methods described herein can mitigate NOx during transient engine operation, an operational mode in which emissions are difficult to predict and control. The above control schemes can be used to mitigate NOx during disturbances in engine operation, such as high ramp rate transients, during which emissions are difficult to predict and control. The accuracy of the compressor molar flow rate is high, and determination time is low, providing a quicker response to changes in gas turbine loads.

The foregoing description is provided in the context of one possible application for the system according to aspects of the invention. While the above description is made in the context of the exhaust of a turbine engine, it will be understood that the system according to aspects of the invention may be applied to other applications in which selective catalytic reduction systems are used. Thus, it will of course be understood that the invention is not limited to the specific details described herein, which are given by way of example only, and that various modifications and alterations are possible within the scope of the invention as defined in the following claims.

What is claimed is:

1. A method of treating an exhaust flow including nitrogen oxides in a turbine engine, the turbine engine having a selective catalytic reduction system having a catalyst, the turbine engine operating under steady state conditions, the method comprising the steps of:

predicting a molar flow of nitrogen oxides in the exhaust flow;

measuring a molar flow of nitrogen oxides in the exhaust flow;

detecting a disturbance in the steady state operation of the turbine;

determining the difference between the measured molar flow of nitrogen oxides in the exhaust flow and the predicted molar flow of nitrogen oxides in the exhaust flow to yield an error factor;

applying the error factor to the predicted molar flow of nitrogen oxides in the exhaust flow so that the predicted molar flow equals the measured molar flow; and responsive to detecting a disturbance, supplying a reducing agent to the exhaust flow upstream of the catalyst relative to the direction of exhaust flow and based on the predicted molar flow of nitrogen oxides with the error factor applied in the exhaust flow.

2. The method of claim 1 wherein the disturbance is a load ramp.

3. The method of claim 1 wherein the disturbance is a change in at least one of pilot fuel flow rate, duct burner fuel flow rate and premix fuel flow rate.

4. The method of claim 1 wherein the reducing agent is ammonia.

5. The method of claim 1 further including the step of selectively biasing the amount of reducing agent supplied to the exhaust flow upstream of the catalyst.

6. The method of claim 5 wherein the step of selectively biasing the supply of reducing agent is discontinued so that the supply of reducing agent to the exhaust flow upstream of the selective catalytic reduction system is based solely on the predicted molar flow of nitrogen oxides in the exhaust flow of the turbine.

7. The method of claim 1 further including the steps of:

discontinuing the supplying step based on the predicted molar flow of nitrogen oxides in the exhaust flow of the turbine;

measuring the molar flow of nitrogen oxides in the exhaust flow upstream of the selective catalytic reduction system;

supplying a reducing agent to the exhaust flow upstream of the catalyst relative to the direction of exhaust flow and based on the measured molar flow of nitrogen oxides in the exhaust flow.

8. The method of claim 7 wherein the discontinuing step is performed after one of a predetermined amount of time has elapsed or the end of the disturbance.

9. The method of claim 1 wherein the predicting step comprises:

determining a compressor molar flow rate;

determining a fuel molar flow rate; and determining an exhaust molar flow rate by adding the determined compressor molar flow rate and the determined fuel molar flow rate.

10. The method of claim 9 wherein the step of determining a compressor molar flow rate comprises:

determining a reference compressor mass flow rate;

determining a weight of dry air inducted in engine;

determining at least one correction factor;

adjusting the determined reference compressor mass flow rate by the determined weight of dry air inducted in engine and the determined correction factor; and dividing the adjusted reference compressor mass flow rate by the molecular weight of air.

11. The method of claim 10 wherein the correction factor is at least one of a pressure correction factor and a gas turbine degradation factor.

12. The method of claim 10 wherein the turbine engine includes a compressor section with an evaporative cooler, wherein the evaporative cooler has an operational status of one of on or off, and further including the steps of:

determining the operational status of the evaporative cooler;

adjusting the steps of determining the reference compressor mass flow rate and the weight of dry air inducted in engine based on the operational status of the evaporative cooler.

13. The method of claim 9 wherein the step of determining a fuel molar flow rate comprises:

measuring fuel flow in the turbine engine including at least one of pilot fuel flow and premix fuel flow; and dividing the measured fuel flow by the molecular weight of the fuel.

14. The method of claim 13 wherein the step of determining a fuel molar flow rate further includes measuring fuel flow in a duct burner.

15. The method of claim 1 wherein, when a disturbance is detected, further including the steps of holding the current error factor constant.

16. A selective catalytic reduction system for treating an exhaust flow including nitrogen oxides in a turbine engine comprising:

a turbine engine having an exhaust section fluidly connected to receive an exhaust flow from a turbine section of the engine;

a selective catalytic reduction system having an injector and a catalyst, the catalyst being disposed in the exhaust flow and downstream of the injector relative to the direction of exhaust flow;

a reducing agent supply source in fluid communication with the injector by a fluid conduit;

a flow control valve disposed along the fluid conduit; and an electronic control circuit operatively connected to flow control valve, the electronic control circuit comprising instructions which;

determine the difference between a measured molar flow of nitrogen oxides in the exhaust flow and a predicted molar slow of nitrogen oxides in the exhaust flow to yield an error factor;

apply the error factor to the predicted molar flow of nitrogen oxides in the exhaust flow so that the predicted molar flow equals the measured molar flow during steady state operation of the turbine engine, direct the flow control valve to supply a reducing agent to the injector in an amount based on the measured molar flow of nitrogen oxides in the exhaust flow, during a disturbance in the operation of the turbine engine, direct the flow control valve to supply a reducing agent to the injector in an amount based on the predicted molar flow of nitrogen oxides with the applied error factor in the exhaust flow.

17. The system of claim 16 wherein the predicted molar flow of nitrogen oxides is determined by the summation of a compressor molar flow rate and a fuel molar flow rate.

18. The system of claim 17, wherein the error factor is the difference between the predicted molar flow of nitrogen oxides and the measured molar flow of nitrogen oxides upstream of the selective catalytic reduction system relative to the direction of the exhaust flow.

* * * * *